United States Patent [19]

Header et al.

[11] Patent Number: 4,687,267

[45] Date of Patent: Aug. 18, 1987

[54] CIRCUIT BOARD EDGE CONNECTOR

[75] Inventors: Stephen Header, Chambersburg; Jerry L. Moore, Harrisburg; Attalee S. Taylor, Palmyra, all of Pa.

[73] Assignee: AMP Incorporated, Harrisburg, Pa.

[21] Appl. No.: 879,790

[22] Filed: Jun. 27, 1986

[51] Int. Cl.[4] ..... H01R 9/09

[52] U.S. Cl. ..... 439/62; 439/607; 439/64

[58] Field of Search ..... 339/14 R, 17 R, 17 L, 339/17 LC, 143 R, 176 M, 176 MP, 184 R, 184 M, 186 R, 186 M

[56] References Cited

U.S. PATENT DOCUMENTS

| | | | |
|---|---|---|---|
| 3,299,392 | 1/1967 | Evans | 339/17 L |
| 3,334,325 | 8/1967 | Conrad et al. | 339/14 R |
| 3,634,806 | 1/1972 | Fergusson | 339/14 R |
| 3,864,000 | 2/1975 | Coller et al. | 339/64 M |
| 3,892,464 | 7/1975 | Griffin | 339/184 M |
| 4,045,114 | 8/1977 | Dechelette | 339/210 M |
| 4,425,015 | 1/1984 | Rizzo | 339/17 LC |

FOREIGN PATENT DOCUMENTS

| | | | |
|---|---|---|---|
| 2732487 | 1/1978 | Fed. Rep. of Germany | 339/17 LC |
| 2239839 | 2/1975 | France | 339/17 LC |

*Primary Examiner*—Neil Abrams

*Attorney, Agent, or Firm*—Allan B. Osborne

[57] ABSTRACT

A circuit board edge connector for mounting on a circuit board and electrically connecting conductive traces thereon to contact elements in a connecting mating member into which the edge connector may be inserted. More particularly, the edge connector includes contact elements positioned in a housing with elongated fingers on the contact elements extending onto a blade extending outwardly from the housing and pins on the contact elements extending outwardly from the housing for electrical engagement with conductive traces on the circuit board on which the edge connector is mounted. Upon inserting the blade into a slot in the connecting mating member, the fingers electrically engage the contact elements therein to complete the electrical path from the conductive traces on the board.

7 Claims, 15 Drawing Figures

CIRCUIT BOARD EDGE CONNECTOR

FIELD OF THE INVENTION

The present invention relates to electrical connectors and, more particularly, to a connector for attachment directly to conductive circuits disposed along the edges of a printed circuit board and having an outwardly extending blade for electrical connection with a connecting mating member.

BACKGROUND OF THE INVENTION

A problem associated with printed circuit boards, particularly with the thicker, multi-layer boards, is that standard card edge connectors are made with standard spacings between opposed rows of contact elements and the thickness of the circuit board may vary. Accordingly, this variation in spacing between opposed rows of conductive traces or plated fingers along opposite facing edges of the board will produce a variation in the insertion and withdrawal forces of the board edge into the connector and more importantly it effects the reliability with which mating surfaces engage one another.

Another problem associated with circuit boards is that the fingers require plating with noble metals such as gold to prevent corrosion thereof. Gold plating of these fingers is quite expensive in that substantial gold scrap is produced thereby which requires expensive refining techniques to recover. Moreover, gold plating requires additional manufacturing time in making circuit boards and in the event any one of the plated fingers becomes damaged in the manufacturing process, very often the entire board may have to be scrapped.

Connectors having rows of contact elements for mounting to the edge of circuit boards have been developed to obviate the need of plating the traces or fingers on the circuit board. These connectors include a blade extending outwardly from a housing on which are conductive fingers extending from conductive contact elements located in the housing. The connectors are mounted on an edge of the circuit board with leads or pins on the contact elements electrically engaging conductive traces or fingers thereon. Thus, when the blade is inserted into a connecting mating member; e.g. a card edge connector, the traces on the board are electrically connected to traces or circuits on a board or backplane on which the connecting mating member is mounted. However, despite the fact that they eliminate the overall disadvantage of forming plated fingers on the circuit board edge, the prior art edge connectors possess some disadvantages. For example, the fingers generally lay in grooves and are flush with the surface of the blade. When there is lateral shifting between the edge connector and connecting mating member in which the blade is inserted; side to side float due to tolerance mismatch and the like, conductive elements in the mating member will shift off the fingers and onto the blade and break off electrical contact. Another disadvantage with prior art connectors is that the fingers on the blade next to the keying slots are free to shift thereinto so that during insertion they strike the key in the mating member and become damaged. Another disadvantage with prior art connectors is that cross-talk and impedance mismatch between fingers on opposite surfaces of the blade can occur.

It is therefore desirable to provide an edge connector wherein the distal ends of the fingers are necked down and positioned below the surface of the blade to prevent them from being caught and peeled back during insertion but with the rest of the fingers being above the surface of the blade so that at least some of the conductive elements of the mating member will remain engaged therewith during the aforementioned lateral shifting. Further, by reducing the width of the distal ends of the fingers, a barrier between the distal end portion of the fingers and the keying slot prevents the fingers from shifting thereinto. Further, it is desirable to provide an edge connector wherein a ground plane is placed within the blade to minimize cross-talk between fingers and improve impedance/capacitance characteristics. Also, it is desirable to provide an edge connector having sequential contact engaging capabilities.

SUMMARY OF THE INVENTION

According to the present invention, a circuit board edge connector is provided having an insulative housing with a blade extending outwardly from a body containing cavities and electrical contact elements positioned in the cavities with elongated fingers having necked down distal ends extending out onto opposing surfaces of the blade for electrical engagement with conductive elements in a connecting mating member into which the blade is inserted. Further, some fingers on the contact elements may extend less further out onto the blade for sequential electrical engagement. A ground plane may be included within the blade between opposing surfaces to minimize cross-talk between the fingers on the opposite surfaces, and to improve impedance/capacitance characteristics.

DESCRIPTION OF THE INVENTION

Figure 1:
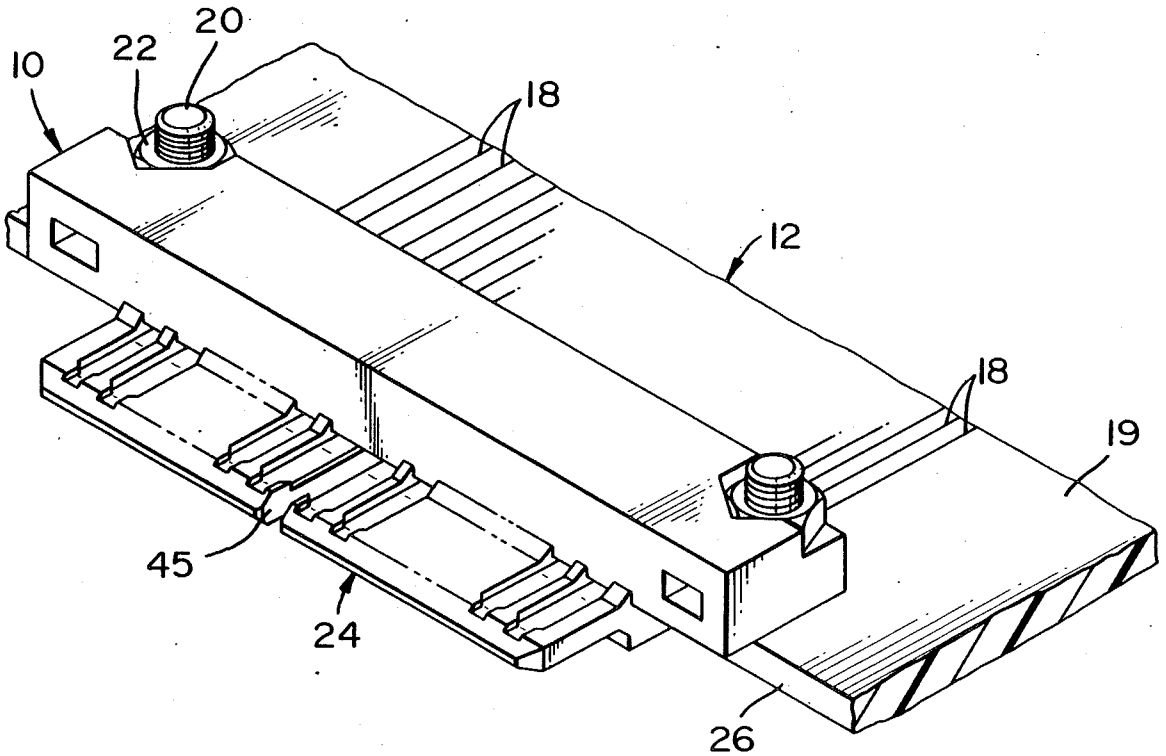
FIG. 1 is a perspective view of the connector of the present invention mounted on an edge of a printed circuit board.

FIG. 1 shows connector 10 of the present invention mounted on printed circuit board 12 with first and second contact elements 14, 16 respectively (FIG. 2) of connector 10 making electrical engagement with conductive traces 18 on surface 19 of board 12. Connector 10 is fastened to board 12 by means of bolts 20 and nuts 22. Other fastening means, such as rivets (not shown) could be used if desired. Connector 10 includes a blade 24 which projects outwardly from edge 26 of board 12 for insertion into a connecting mating member; e.g., a card edge connector (not shown).

Figure 2:
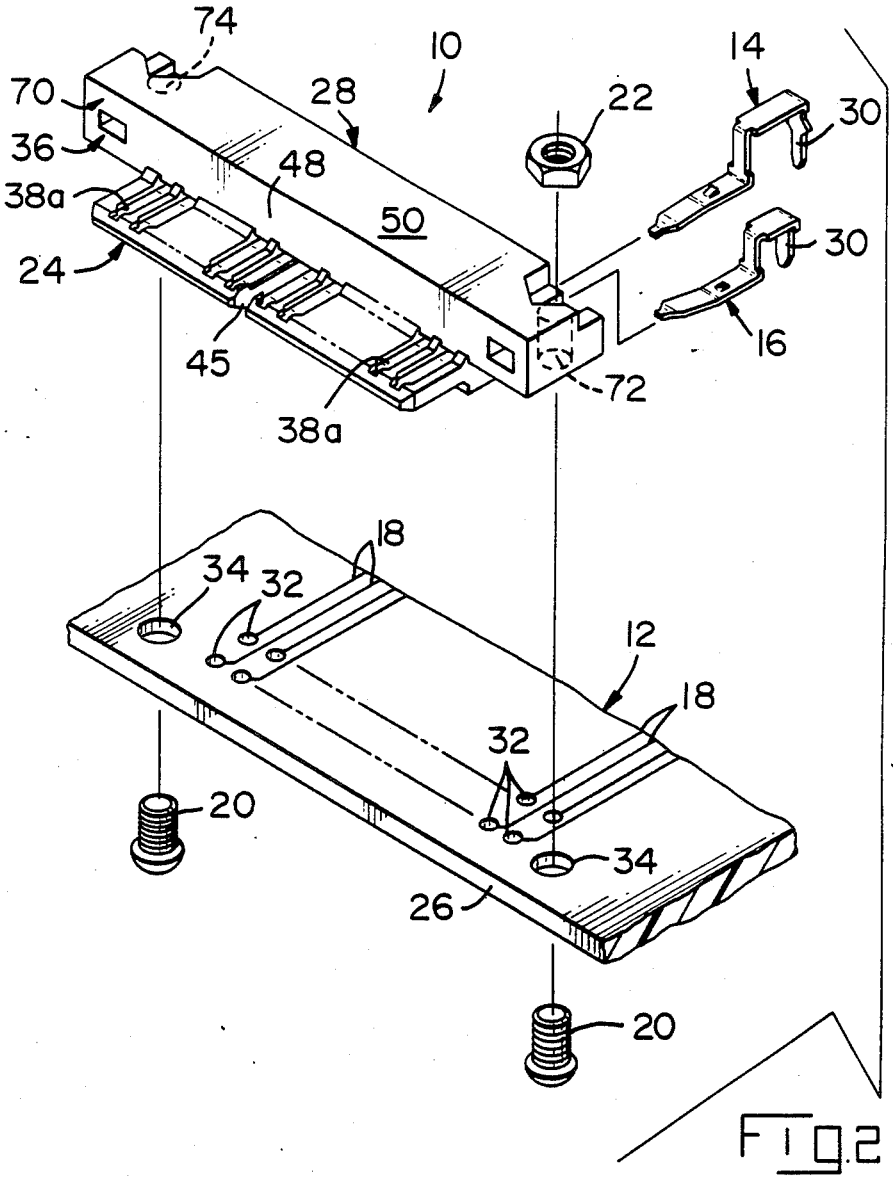
FIG. 2 is a perspective view of the connector with the contact elements exploded from the housing.

FIG. 2 shows contact elements 14, 16 exploded from housing 28 of connector 10 and connector 10 exploded away from board 12. Contact elements 14, 16 include pins 30 which are received and soldered in plated through holes 32 in board 12 to made electrical engagement with traces 18 thereon. FIG. 2 also shows holes 34 in board 12 through which bolts 20 extend.

Figure 3A:
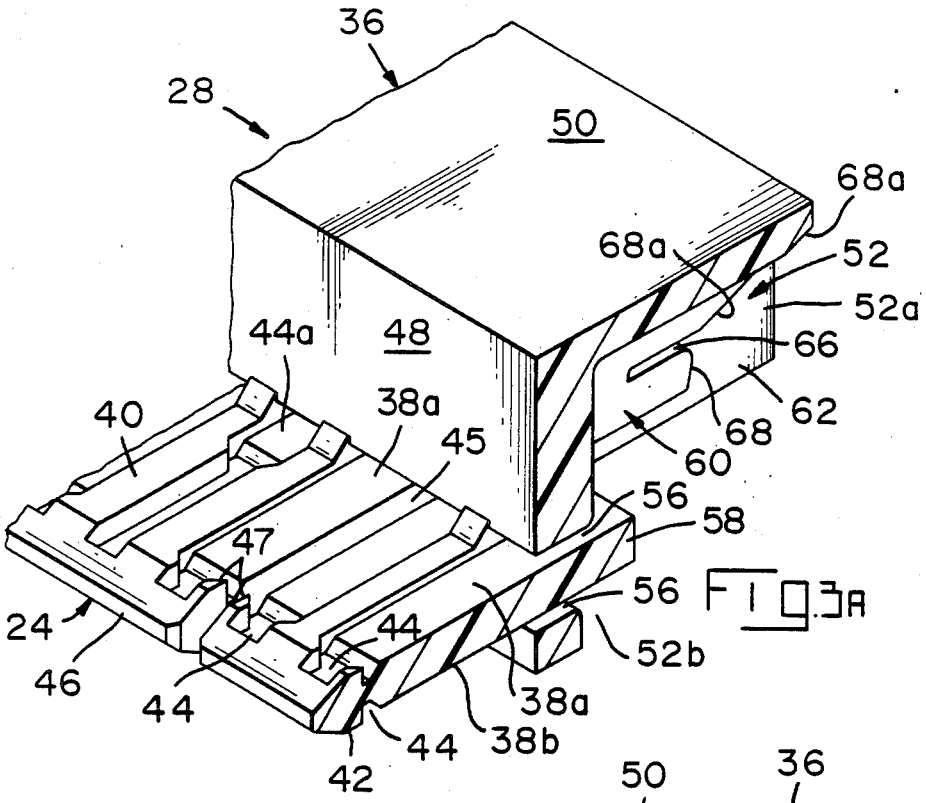
FIG. 3A is a perspective, sectional view of a portion of the housing of the connector.
Figure 3B:
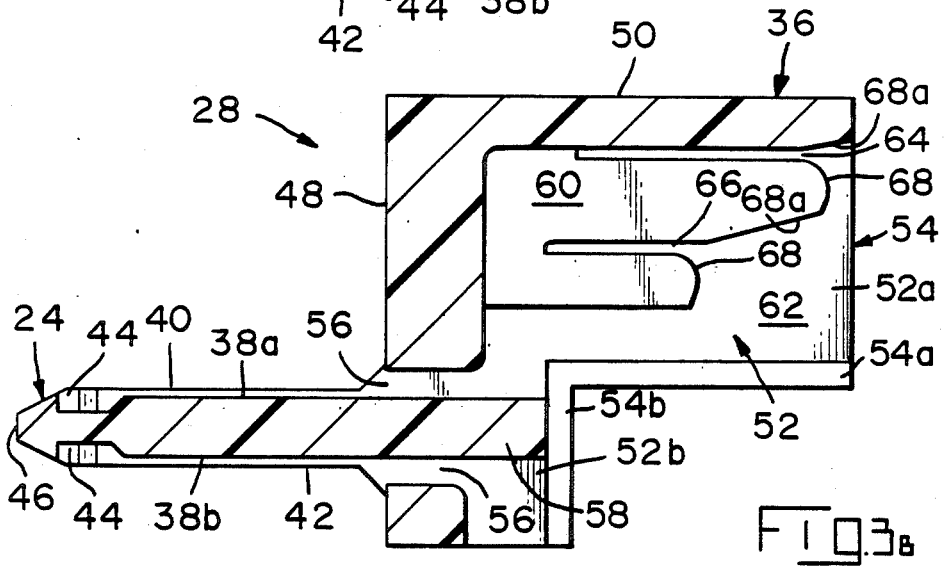
FIG. 3B is a side sectional view of the housing of the connector.

As shown in FIGS. 3A and 3B, housing 28 of connector 10 includes body 36 and the aforementioned blade 24. Sets of aligned grooves **38*a*, 38*b* are provided on blade 24 with groove 38*a* located on surface 40 thereof and groove 38*b* located on opposing surface 42. Grooves 38*a,b* include a recessed portion 44 at the terminal ends thereof which is inwardly of free end or tip 46 of blade 24. Alternatively, as shown in FIG. 3A, an elongated recessed portion 44*a* extends further rearwardly to receive modified contacts 14, 16 as will be described below. Tip 46 is beveled on both surfaces 40, 42 with the bevel preferably being at twenty five degrees relative to the plane of blade 24**.

Blade 24 may include one or more keying slots 45. Barrier 47, which extend slightly beyond surfaces 40, 42, are provided between such slots 45 and grooves **38*a,b* immediately adjacent thereto. As shown, barriers 47 are next to recessed portions 44**.

Figure 3C:
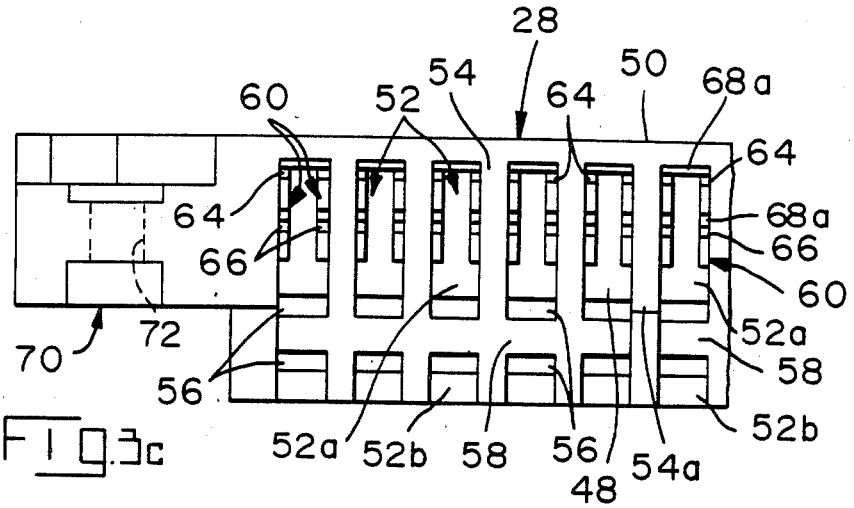
FIG. 3C is a plan view looking into the back of the housing of the connector.

Body 36, as shown in FIGS. 3A, 3B, 3C is L-shaped as viewed from a side and comprises from wall 48, top wall 50 and a number of contact receiving cavities 52 defined by L-shaped inner walls 54 which extend rearwardly from front wall 48 and downwardly from top wall 50. Slots 56, one on each side of ledges 58, which are parallel with blade 24, extend through front wall 48 to connect cavities 52 with respective sets of grooves **38*a,b* on blade 24**.

Cavities 52 which open out rearwardly and downwardly, are divided into an upper portion **52*a* and lower portion 52*b* by ledges 58 which extend transversly between adjacent inner walls 54**.

As shown in FIG. 3B, certain of inner walls 54, periodically spaced along the length of body 36, extend further downwardly from cavity upper portion **52*a* to provide horizontal standoffs 54*a* and extend further rearwardly from cavity lower portion 52*b* to provide vertical standoffs 54*b***.

Steps 60 project into cavity upper portions **52*a* from each side 62 of inner walls 54. First and second channels 64, 66 respectively, which open out rearwardly and laterally into cavities 52 are provided in each step 60 as are arcuate surfaces 68 which are located at the mouth of and below each channel 64, 66. Beveled surfaces 68*a* are located on top wall 50 and steps 60 opposite arcuate surfaces 68**.

As shown in FIG. 2, mounting portions 70 are provided on each side as an integral part of body 36. Holes 72, extending vertically therethrough, open out into recesses 74, located in top wall 50 of body 36. Bolts 20 extend through holes 72 inot recesses 74 for threaded engagement with nuts 22 located therein.

Housing 28 is molded from a suitable dielectric material such as a glass fiber reinforced polyethylene terephthalate.

Figure 4A:
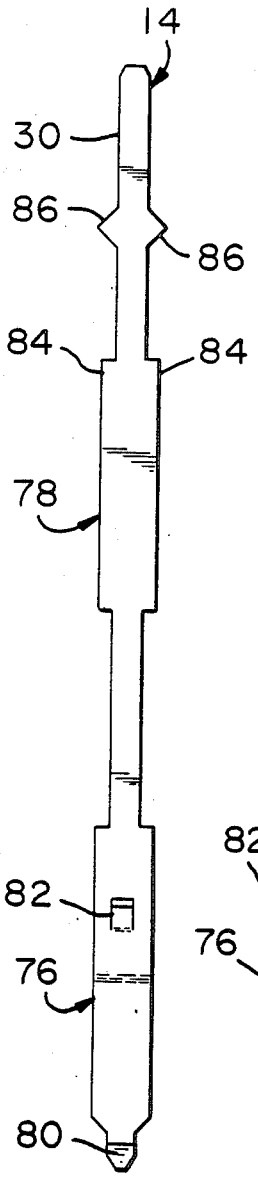
FIGS. 4A, 4B, and 4C are plan, side and perspective views respectively of the first contact element of the connector.
Figure 4B:
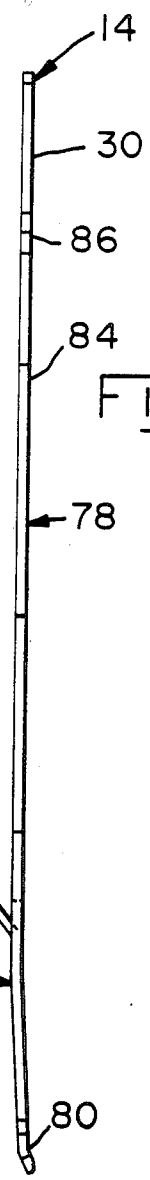

As shown in FIGS. 4A, B, C and 5A, B, C, first and second contact elements 14, 16 respectively have substantially the same form and include outwardly extending contact sections or singers 76, retaining sections 78 and the aforementioned pins 30.

Fingers 76 culminate in narrow distal ends 80 which are bent out of the plane thereof. Lances 82 on elements 14 extend obliquely rearwardly from surfaces **76*a* of fingers 76 while lances 82 on elements 16 extend obliquely rearwardly from opposite surfaces 76*b*. The portion of finger 76 forwardly of lance 82 is bowed very slightly with surface 76*b* on element 14 and surface 76*a* on element 16** being concave.

Laterally projecting mounting ears 84 are provided along each side of a portion of retention section 78 on both elements 14, 16.

Barbs 86 are provided on both sides of pin 30 of first contact element 14.

Contact 14 differs from contact 16 in the length of retention section 78 and pins 30, barbs 86 on elements 14 and the aforementioned bowing of fingers 76 and location of lances 82.

Figure 4C:
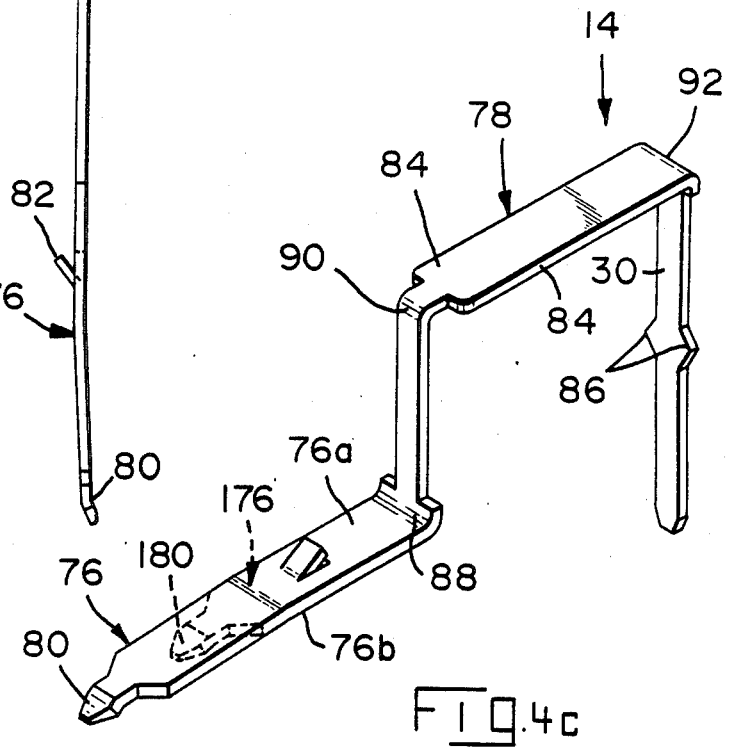
Figure 5A:
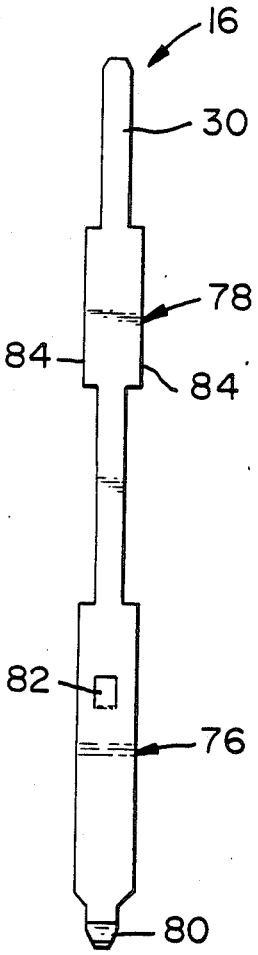
FIGS. 5A, 5B and 5C are plan, side and perspective views respectively of the second contact element of the connector.
Figure 5B:
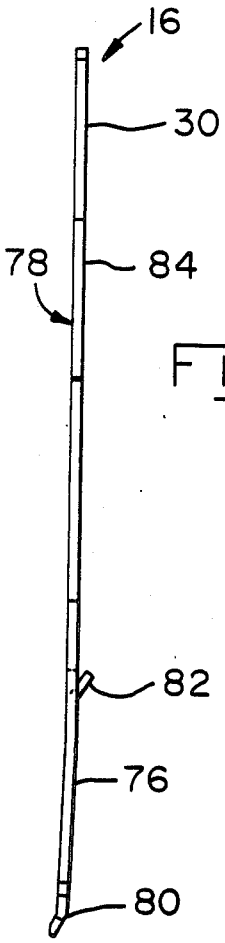
Figure 5C:
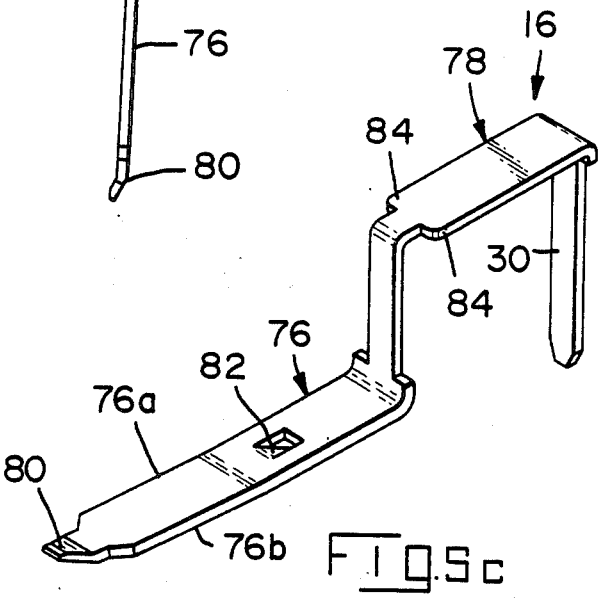

Contact elements 14, 16 are stamped from phosphor bronze or other suitable material and formed by bending ends 80 of fingers 76 and making right angle bends 88, 90 and 92 as shown in FIGS. 4C, 5C with bend 92 being made after insertion into cavities 52. Fingers 76 are preferably plated with gold along surface **76*a* of contact 14 and surface 76*b* of contact 16**.

Figure 8:
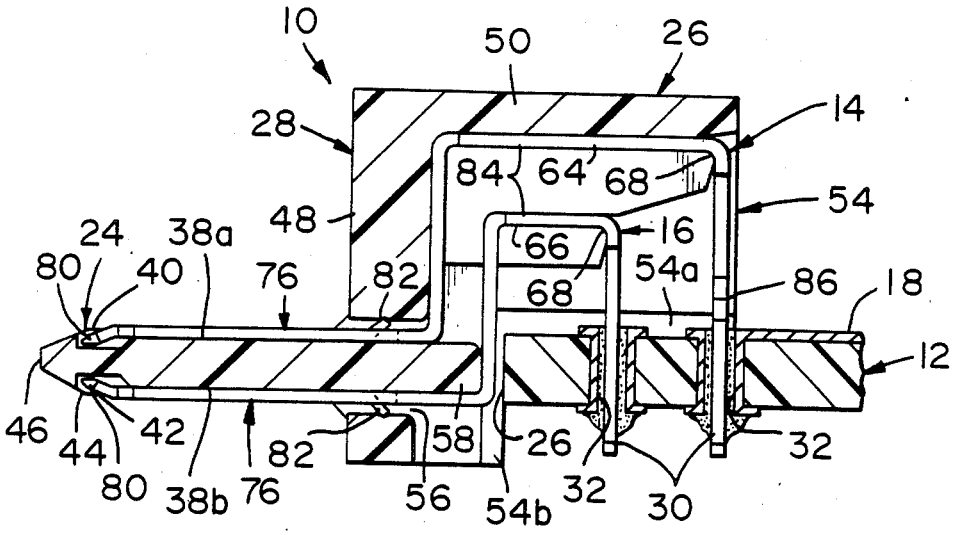
FIG. 8 is a side sectioned view of the assembled connector mounted on the circuit board.

Pins 30 as shown are suitable for being soldered in holes 36 in board 12 (FIG. 8). However, other types of pins could be provided on elements 14, 16; e.g., a compliant section (not shown) such as disclosed in U.S. Pat. No. 4,186,982 or feet (not shown) to be soldered or pressure mounted to conductive pads (not shown) on board 12.

Contacts 14, 16 may be provided having shorter length fingers 176 as shown in phantom in FIG. 4*c* to be placed in grooves **38*a,b* having elongated recessed portions 44*a*** to provide sequential contact engagement capabilities.

Figure 6:
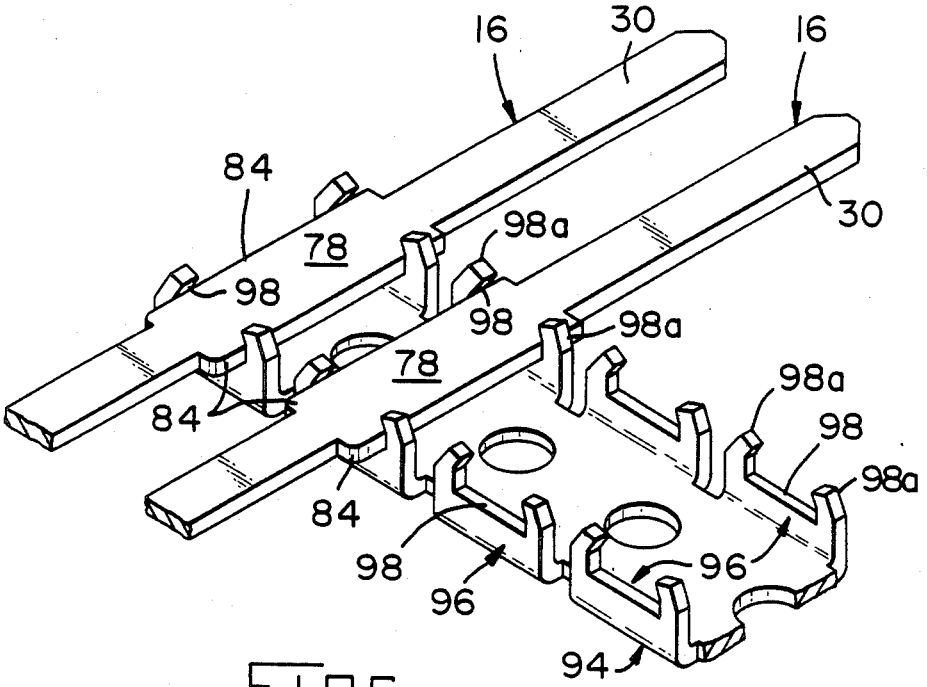
FIG. 6 is a perspective view illustrating contact elements loaded onto a bandolier.

Contact elements 14, 16 are conveniently positioned on and carried after stamping on an elongated bandolier 94 shown in FIG. 6. Aligned, upwardly projecting tabs 96, spaced along each side of bandolier 94, have U-shaped notches 98 with free ends **98*a* thereof bend inwardly towards each other to retain elements 14, 16 therein. As shown, the portion of retaining sections 78 containing ears 84 are received in the aligned notches 98 on each side of bandolier 94. Bandolier 94** is preferably stamped and formed from brass or other suitable material.

Figure 7:
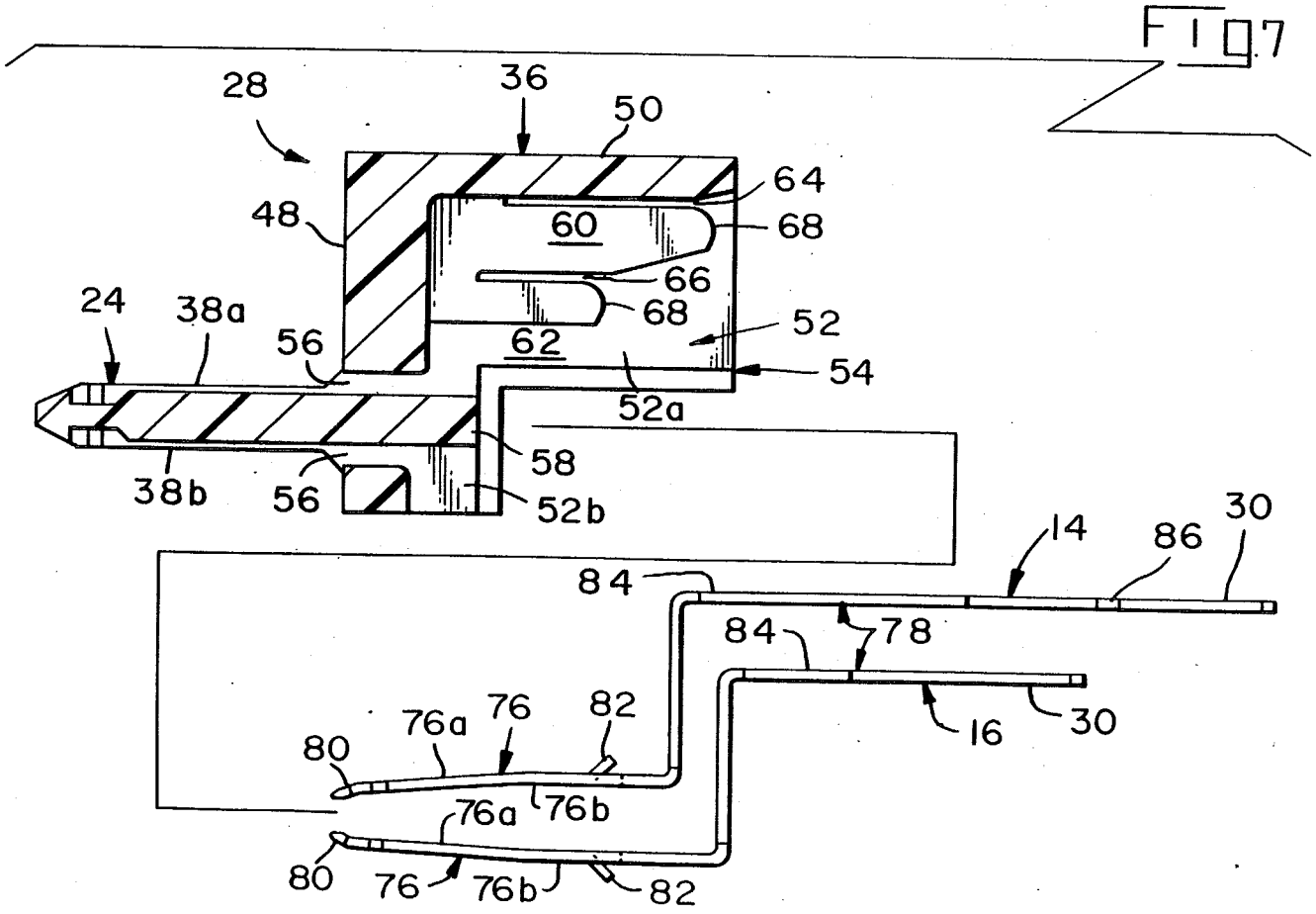
FIG. 7 is a side sectional view of the housing with the contact elements exploded out therefrom.

FIG. 7 shown contact elements 14, 16 in position for placing into housing 28 to form connector 10. Insertion into cavity 52 is from the open back end as indicated.

FIG. 8 is a view showing contact elements 14, 16 placed in housing 28. First contact element 14 is located in cavity 52 with ears 84 on retention section 78 being in first channel 64. Finger 76 on element 14, extending through slot 56 above ledge 58 is in groove **38*a* with concave surface 76*b*** facing thereinto.

Second contact element 16 is located in the same cavity 52 with ears 84 being received in second channel 66. Finger 76 of element 16, extending through slot 56 below ledge 58, is in groove **38*b* with concave surface 76*a* facing thereinto. Arcuate surfaces 68 and beveled surfaces 68*a* facilitate insertion of ears 84 of contacts 14, 16 into channels 64, 66**.

As fingers 76 enter slots 56, they resiliently straighten and lances 82 resiliently bend in. After clearing slots 56, fingers 76 spring back to their formed shape. Distal ends 80 of fingers 76 are received in recessed portions 44 of grooves 38*a,b* which places them below the respective surfaces 40, 42 of blade 24. The slight bow of fingers 76 preload distal ends 80 into recessed portions 44. Lances 82 engage the walls at slots 56 to provide stability of elements 14, 16. Forward movement of elements 14, 16 is prevented by ears 84 abutting the ends of respective channels 64, 66 and the portion of retention sections 78 between bends 88, 90, bearing respectively against the inner surface of front wall 48 and ledge 58.

After insertion of contacts 14, 16, third bend 92 is made, bending the rear extremity of retention sections 78 and pins 30 downwardly so that pins 30 extend outwardly through the downward opening of cavities 52 for insertion into respective plated thru holes 32. Bending is accomplished using arcuate surfaces 68 as bending mandrels.

As pin 30 on contact element 14 enters into cavity 52, barbs 86 thereon engage surfaces 62 of inner walls 54 to provide a positive placement between adjacent walls 54, this being necessary due to the pin's long length.

FIG. 8 also shows connector 10 mounted on board 12 with pins 30 on contact elements 14, 16 positioned and soldered in holes 32 in board 12. Standoffs 54*a,b* space connector 10 from board 12 to permit cleaning and washout subsequent to soldering. Bolts 20 and nuts 22, or other fastening means (now shown) locate connector 10 with respect to holes 32 on board 12.

When it is desired to connect traces 18 on board 12 with similar conductive traces on another board or backplane (not shown), blade 24 is inserted into a connecting mating member; e.g., a card edge connector (not shown) so that fingers 76 may electrically engage contact elements therein. The beveled tip 46 facilitates entry and with distal ends 80 on fingers 76 being below surfaces 40, 42 stubbing thereof is avoided. Further, barriers 47 adjacent slots 45 prevent fingers 76 and more particularly distal ends 80 thereon from edging into slots 45 and being snubbed on the key (not shown) in the connecting mating member (not shown).

Figure 9:
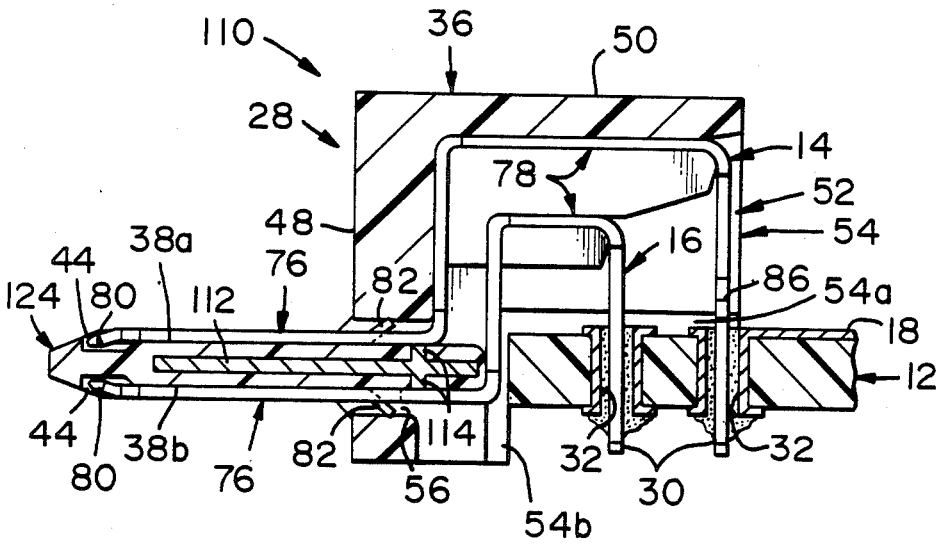
FIG. 9 is a side sectional view of a modified connector.

FIG. 9 illustrates connector 110 which is substantially similar to connector 10 except for the presence of conductive ground plane 112 insert molded into blade 124 between grooves 38*a,b*. Ground plane 112 extends along the length of blade 124 with conductive connecting links 114 extending outwardly from plane 112 to opposing surfaces of ledge 58 to make electrical contact with selected contact elements 14, 16. Links 114 are provided as required; e.g., one at each side of connector 110. Ground plane 112 serves to reduce cross-talk between contact elements 14, 16 as well as providing a ground connection. Further, plane 112 improves the impedance/capacitance characteristics of connector 110.

As can be discerned, a printed circuit board edge connector has been disclosed which is mounted on a circuit board for electrically connecting conductive traces thereon to connecting mating members such as card edge connectors. The connector includes a dielectric housing having a thin blade extending outwardly from a body containing cavities and contact elements positioned in the cavities and having elongated fingers extending outwardly on each side of the blade with distal ends being below the surface thereof. The connector is mounted on an edge of the circuit board with pins on the contact elements electrically engaging the conductive traces on the board and the elongated fingers on the contact elements engaging contact elements in the connecting mating member in which the blade is received. Further, barriers are provided adjacent keying slots to prevent the fingers from sliding thereinto and snubbing the key in the mating member. Sequential contact engagement capabilities are also provided.

A modified connector of the present invention includes a ground plane in the blade to reduce cross-talk between the fingers and to provide a ground connection if desired to selected contacts.

We claim:

1. A circuit board edge connector for electrically connecting conductive means on a circuit board to conductive means in a connecting mating means having a card slot, said connector comprising:

dielectric housing means having body means and blade means, said body means having front and top walls and a plurality of inner walls attached to and extending normally from said front and top walls to define a plurality of rearwardly and downwardly open cavities, raised means on each surface of said inner walls projecting into said cavities and each having upper and lower parallel channels, said body means further having upper and lower, spaced slots extending through said front wall from each of said cavities, said blade means attached to and projecting forwardly from said front wall such that said upper slots open onto an upper surface and said lower slots open onto a lower surface on said blade means, said blade means further having grooves on each upper and lower surfaces in registration with and extending from respective upper and lower slots; and first and second electrical contact means with each having elongated finger means at one end for electrical engagement with conductive means in a connecting mating means, engaging means at another end for electrical engagement with conductive means on a circuit board and disposed at right angles at the longitudinal axis of said contact means, retention means intermediate said finger and engaging means and having laterally projecting ears on each side thereof and lance means on and projecting from said finger means adjacent said retention means, said first electrical contact means being positioned in said housing means with said finger means extending through respective upper slots and along respective grooves on said upper surface of said blade means, said engaging means extending downwardly from respective cavities, said ears on said retention means received in respective upper channels in respective cavities and said lance means engaging a wall of respective upper slots, said second electrical contact means being positioned in said housing means with said finger means extending through respective lower slots and along respective grooves on said lower surface of said blade means, said engaging means extending downwardly from respective cavities, said ears on said retention means received in respective lower channels in respective cavities and said lance means engaging a wall of respective lower slots.

2. The circuit board edge connector of claim 1 further including a ground plane embedded in said blade means and conductive means for electrically connecting said ground plane to selective finger means.

3. The circuit board edge connector of claim 1 further including polarizing keying slots in said blade means with barrier means between said slots and adjacent grooves to prevent finger means from sliding over into said slots.

4. The circuit board edge connector of claim 1 wherein a free end of said blade means includes converging surfaces to provide a lead-in angle for reducing the force of inserting said blade means into a card slot.

5. The circuit board edge connector of claim 4 wherein the surfaces of said free end are beveled at about twenty-five degrees relative to the plane of said blade means.

6. The circuit board edge connector of claim 1 wherein said grooves in said blade means include recessed portions for receiving distal ends of said finger means to prevent said distal ends from being stubbed upon inserting said blade means into a card slot.

7. The circuit board edge connector of claim 1 further including barb means on said first electrical contact means intermediate said retention means and said engaging means, said barb means adapted to engage said surfaces of said inner walls to provide a positive placement of said first electrical contact means in said housing means.

* * * * *